United States Patent [19]

Tomsa

[11] Patent Number: 4,531,802

[45] Date of Patent: Jul. 30, 1985

[54] ELECTRICAL CONNECTOR ASSEMBLY HAVING LOCKING MEANS

[75] Inventor: Vladimir Tomsa, Chicago, Ill.

[73] Assignee: Allied Corporation, Morristown, N.J.

[21] Appl. No.: 604,792

[22] Filed: Apr. 27, 1984

[51] Int. Cl.[3] ..... H01R 13/625

[52] U.S. Cl. ..... 339/90 R; 339/DIG. 2

[58] Field of Search ..... 339/89 R, 89 C, 89 M, 339/90 R, 90 C, 113 R, DIG. 2; 285/82, 86, 89

[56] References Cited

U.S. PATENT DOCUMENTS

| | | | |
|---|---|---|---|
| 1,871,421 | 8/1932 | Muhlhauser | 285/82 |
| 3,351,886 | 11/1967 | Zimmerman, Jr. | 339/90 |
| 3,455,580 | 7/1969 | Howard | 339/90 |
| 3,594,700 | 7/1971 | Nava et al. | 339/89 |
| 3,601,764 | 8/1971 | Cameron | 339/89 |
| 3,665,371 | 5/1972 | Cripps | 339/90 C |
| 3,808,580 | 4/1974 | Johnson | 339/89 R |
| 3,840,839 | 10/1974 | Smaczny et al. | 339/49 |
| 3,901,574 | 8/1975 | Paullus et al. | 339/90 |
| 3,917,373 | 11/1975 | Peterson | 339/89 |
| 3,947,081 | 3/1976 | Peterson | 339/90 |
| 3,971,614 | 7/1976 | Paoli et al. | 339/89 R |
| 4,007,953 | 2/1977 | Powell | 285/321 |
| 4,023,881 | 5/1977 | Migneau | 389/90 R |
| 4,056,298 | 11/1977 | Cooper et al. | 339/90 R |
| 4,059,324 | 11/1977 | Snyder et al. | 339/89 |
| 4,165,910 | 8/1979 | Anderson | 339/89 M |
| 4,204,740 | 5/1980 | Krolak | 339/90 R |
| 4,235,498 | 11/1980 | Snyder | 339/90 |
| 4,239,315 | 12/1980 | Lacaze, Jr. | 339/89 |
| 4,290,662 | 9/1981 | Storcel | 339/89 M |
| 4,305,180 | 12/1981 | Schwartz | 339/90 |

*Primary Examiner*—John McQuade

*Attorney, Agent, or Firm*—C. D. Lacina

[57] ABSTRACT

A bayonet-type lock arrangement in an electrical assembly for resisting unwanted rotation of a coupling member when a pair of connector members (10, 20) are in metal-to-metal contact, the lock arrangement including a one piece lock ring (56) having three cams (58) with each cam being disposed in the terminus of one of the helical grooves and each including a cam surface (58*c*) and an abutment shoulder (58*d*), a locator key (60) on the lock ring being received in an axial keyway (62) of the coupling member to maintain each cam in its respective terminus (53), and a waved washer (52) biasing the lock ring forwardly, each of the bayonet pins (18) passing over the respective cam surfaces being captivated and prevented by the respective abutment shoulders from uncoupling rotation.

11 Claims, 11 Drawing Figures

FIG. 2
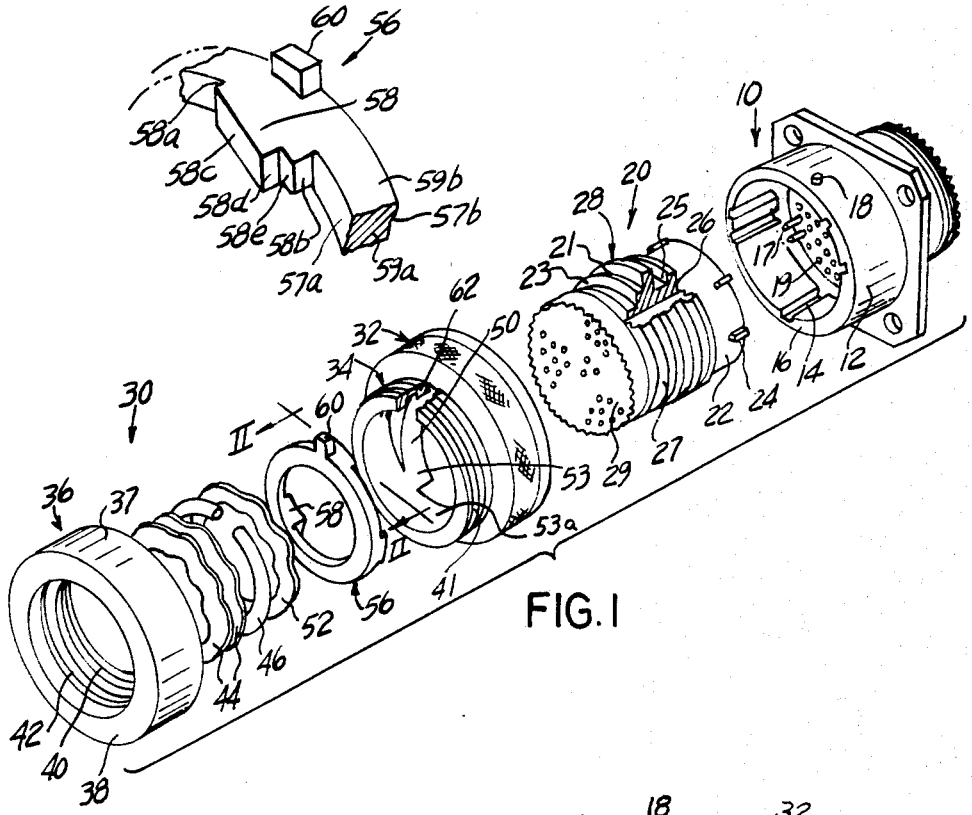
FIG. 1
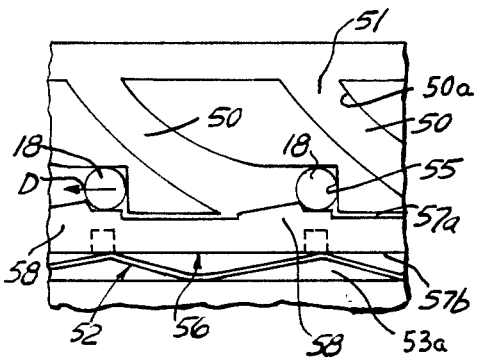
FIG. 5
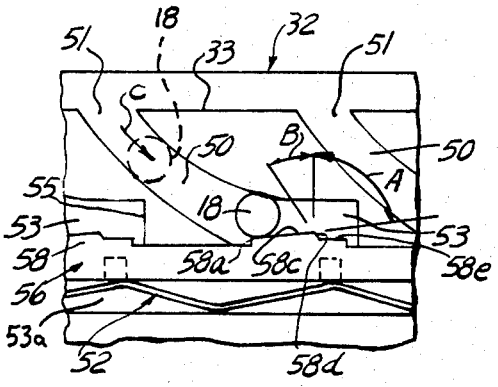
FIG. 4

FIG. 3
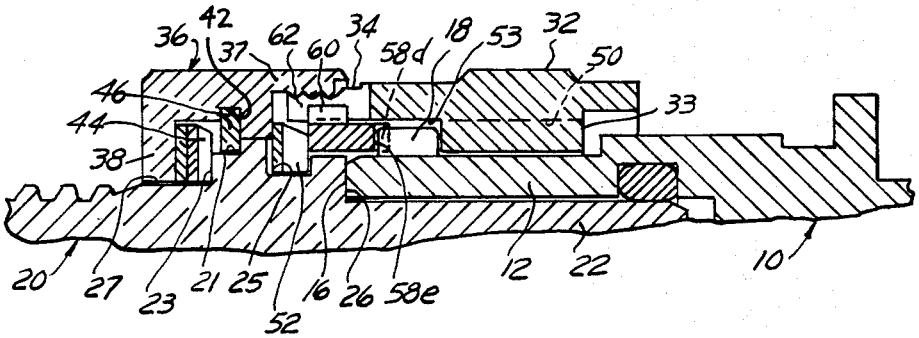
FIG. 6
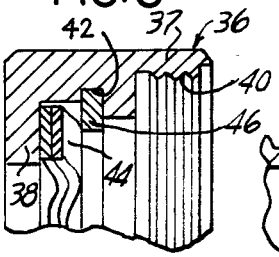
FIG. 7
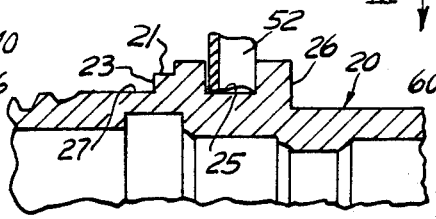
FIG. 8
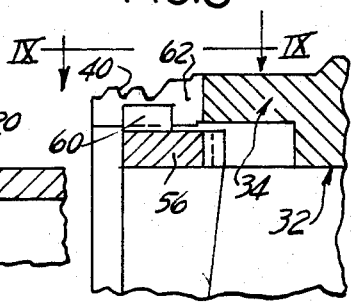
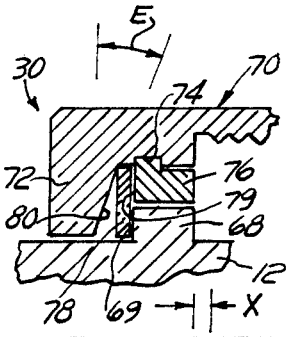
FIG. 10A
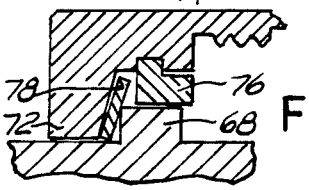
FIG. 10B
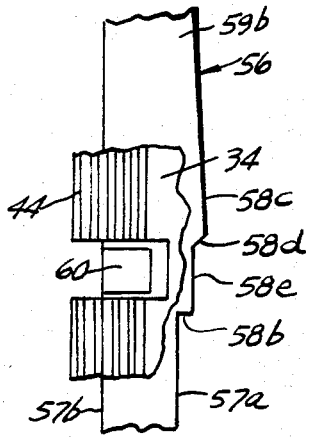
FIG. 9

ELECTRICAL CONNECTOR ASSEMBLY HAVING LOCKING MEANS

This invention relates to an electrical connector assembly having locking means which provides an audible signal that the assembly is locked.

An electrical connector assembly includes a rotatably mounted coupling member both to assemble and to retain plug and receptacle connector members together in mated relation and includes means for preventing unwanted rotation of the coupling member to prevent unwanted separation of the connector members after mating has been achieved. One locking arrangement comprises a bayonet connection wherein a force generated by a compressed wave washer causes bayonet pins from the receptacle to work against bayonet grooves on the coupling member and to seat in a detent disposed at the end of the groove, the biased seating preventing unwanted rotation of the coupling member and indicating that a fully mated condition is achieved. In some applications wherein RFI/EMI shielding is a consideration, metal-to-metal contact between the mated connector members is absolutely essential for proper operation of the connector. Because of the cooperation of the wave washer and action of the bayonet pin with the groove, excessive wear is known to occur. Such wear could cause the detents to become shallow and compromise the metal-to-metal contacting and locking arrangement.

In U.S. Pat. No. 3,455,580, "Locking Device In A Bayonet Electrical Connector", issuing July 15, 1969 to Howard, a one-piece C-ring includes three "U-shaped" bumps for mounting the C-ring against an end wall of the coupling nut and three "V-shaped" risers spaced 120° apart for opposing reverse movement of the bayonet pins once advanced thereover. Such a C-ring may be undesirable because 120° spacing of the risers may not be accurately maintained. The bayonet pin works against the sidewall of a bayonet groove adjacent to the riser and must deflect the riser to be captivated. However, the axial separation of the sidewall relative to the endwall varies. After each bayonet pin overcomes the apex of its riser, the C-ring and thus the risers may become distorted whereupon the risers cam the pin against the sidewall so that the forward axial advance of the bayonet pin does not result in plug and receptacle connector members mating in metal-to-metal contact. Accordingly, to assure such metal-to-metal contact it would be desirable to provide a bayonet pin arrangement which is securely locked into a detent.

In U.S. Pat. No. 4,235,498, "Electrical Connector With Locking Means", issuing Nov. 25, 1982 to Synder, a one-piece locking ring includes a row of detents defined by a succession of peaks and valleys, each detent being adapted to captivate a bayonet pin driven thereacross. The user, in some applications, may not know if the last detent—indicative of metal-to-metal contact—was in fact reached. While such a design has been suitable for the purposes intended, a single captivating detent would provide a single audible click to indicate full-mate and thus may be more desirable by the user in the field.

A general object of this invention is to provide an improved locking means which resists unwanted rotation of a coupling member relative to mated electrical connector members, provides an audible "click" to indicate that full mating and metal-to-metal contact has been achieved and maintains metal-to-metal contact between the connector members when mated.

A separable electrical connector assembly comprises mating plug and receptacle connector members, a coupling member rotatably mounted to the plug and having a set of helical grooves adapted to engage with a like set of bayonet pins extending from the receptacle to draw the plug and receptacle connector members together into mated relation, and lock means for preventing unwanted uncoupling rotation of the coupling member to prevent retraction of the connector members from mated relation.

Improved lock means for preventing unwanted rotation of the coupling nut after the connector members are mated in metal-to-metal contact comprises an annular lock ring including a set of cams the V-shaped peaks of which taper outwardly from a forward axial face thereof, means for locating each of the cams adjacent to the terminus of its helical groove and constraining the lock ring for longitudinal movement relative to the connector assembly, and means for normally biasing the lock ring axially forward, the lock ring being one-piece and carried by the plug connector member for axial movement from a first to a second position. A detent for captivating a bayonet pin is defined in each helical groove by each cam in cooperation with the respective terminus, each V-shaped peak dropping off sharply and including contiguous therewith a land for seating and driving the pin axially forward against its groove. The locating means comprises an axially extending keyway on an inner wall of the coupling member that receives a key extending radially outward from the lock ring.

To uncouple the assembly an external torque placed on the coupling member by the user overcomes the forward bias on and pushes the lock ring axially rearward. A low torque only drives the bayonet pin against the cam. However, even though the abutment shoulder is steeply inclined, increased torque cams the lock ring axially rearward and against the waved washer whereby the bayonet pin is disengaged from the detent and wanted uncoupling rotation relative to the coupling member is permitted.

Resilient means are disposed between adjacent flanges of the plug shell and coupling member for damping vibration forces which may act on the coupling member and comprise an annular pair of waved washers or frusto-conically shaped belleville washers being placed side-by-side and between the flanges, and the inner and outer radial portions of a closed annular washer are adjacent, respectively, a frusto-conical end wall of the coupling member and an axial end wall of the plug shell.

A more complete understanding of this invention may be obtained from the detailed description which follows taken in conjunction with the accompanying drawings, in which:

FIG. 1 is an exploded view of an electrical connector assembly having a bayonet type coupling arrangement.

FIG. 2 is a partial section of an annular lock ring.

FIG. 3 is a partial side view in section of the mated electrical connector assembly.

FIG. 4 is an unfolded view of the inner wall of a coupling member showing a bayonet pin advancing in its helical groove and approaching a locked engagement.

FIG. 5 is similar to FIG. 4 and shows the bayonet pin in locked engagement.

FIGS. 6, 7 and 8 are side views, in section, showing assembly of the coupling member to the plug connector.

FIG. 9 is a partial view taken along lines IX—IX of FIG. 8 showing a fragment of the coupling member superposed over a portion of the lock ring.

FIGS. 10A and 10B show an alternate coupling member.

Referring now to the drawings, FIG. 1 shows a separable electrical connector assembly comprising receptacle and plug connector members 10, 20 adapted for a quick connection by a coupling member 30 utilizing a bayonet-type coupling arrangement for drawing the connector members together, the coupling arrangement including a releasable locking arrangement for locking the connector members together in metal-to-metal engagement, and a keying arrangement for orienting the plug relative to the receptacle and constraining the plug to be drawn axially into abutting engagement with the receptacle upon rotation of coupling member.

Receptacle connector member 10 comprises a generally cylindrical metal shell 12 having an internal keyway 14, and a transverse end face 16. An insert 19 of dielectric material is mounted in the shell and carries a plurality of pin-type contacts 17 therein. Additionally, three radially extending bayonet pins 18 are circumferentially spaced equiangularly about the periphery of shell adjacent end face 16 thereof.

Plug connector member 20 comprises a generally cylindrical metal shell 22 including an external axial key 24, an annular flange 28, and an annular wall 27 rearwardly of the flange, the annular flange 28 having a forward axial face 26, a stepped rearward axial end face 23, and an annular groove 25. The forward axial face 26 is adapted to abut end face 16 of the receptacle shell at full-mate and the stepped rearward axial end face 23 includes an annular shoulder 21. An insert 29 of dielectric material is mounted in shell 22 and carries a plurality of socket-type contacts (not shown) therein, the socket-type contacts being adapted to be connected separately with corresponding of the associated pin-type contacts.

The coupling member 30 is adapted to be rotatably mounted to plug shell 22 and connect to receptacle shell 12 and comprises a retaining nut 36 adapted to be non-removably secured to a coupling sleeve 32 including a collar 34. The retaining nut 36 includes a cylindrical retaining sleeve 37 and an annular flange 38 extending radially inward from sleeve 37, the retaining sleeve 37 having its inner wall provided with internal thread 40 and an annular recess 42, and the annular flange 38 being sized to clearance fit about plug shell 22. Collar 34 is concentric with coupling sleeve 32 and extends axially rearward therefrom, the outer periphery of the collar including external thread 41 for engaging with the internal thread 40 and an axial keyway 62.

A pair of waved washers 44 are adapted to seat around the annular wall 27. A retaining ring 46 is adapted to seat about the annular shoulder 21 and fit annular recess 42 on the inner wall of retaining nut 36 to captivate the waved washers against the annular flange 38.

Coupling sleeve 32 is provided with a set of three internal helical grooves 50, each groove corresponding to one of the bayonet pins 18 extending from receptacle shell 12. Although shown best in FIGS. 4 and 5, the three helical grooves each have an entrance port 51 opening on the front face 33 of coupling sleeve 32, a helical wall 50*a* for driving the pin rearwardly to its terminus 53 and an annular wall 53*a* which intersects the terminus 53 (see FIG. 4), the set of helical grooves 50 being adapted to register with respective of the set of bayonet pins 18 to threadably engage therewith, rotation of the coupling member 30 in threading engagement drawing the plug into the receptacle and the sleeve about the receptacle until the plug and receptacle have their respective faces 16, 26 in tightened metal-to-metal contact with each bayonet pin 18 being in engagement with the forward helical wall 50*a* of its helical groove.

A locking arrangement includes a waved washer 52 sized to mount in the annular groove 25 disposed about the plug shell, and an annular one-piece closed lock ring 56 sized to clearance fit about annular flange 28 of plug shell 20 axially forward of the waved washer 52, the lock ring being generally planar and including a plurality of cams 58 extending perpendicularly forward therefrom, and a locking key 60 extending radially outward therefrom. The locking key is adapted to be received in axial keyway 62 of collar 34 so that each of the cams 58 are always located adjacent to the terminus 53 of one helical groove 50 to define a detent which will captivate the bayonet pin 18 received therein and prevent unwanted reverse rotation of the coupling nut. The locking key 60 and keyway 62 constrains the lock ring 56 to rotate with the coupling member 30 and for axial movement from a forward first position, biased forwardly by the waved washer 52, and to a rearward second position upon engagement of the cam by the bayonet pin.

FIG. 2 shows a portion of lock ring 56, the locking key 60 and one of the cams 58, the lock ring comprising front and rear axial faces 57*a*, 57*b*, the inner and outer circumferential faces 59*a*, 59*b*, the locking key 60 extending radially outward from circumferential face 59*b*, and the cam 58 extending axially forward from front axial face 57*a* and including a V-shaped peak. The cam comprises a pair of sidewalls 58*a*, 58*b*, a cam surface 58*c*, an abutment shoulder 58*d*, and a land 58*e*, the sidewalls 58*a*, 58*b* and the land 58*e*, respectively, being generally perpendicular and parallel to a plane including the lock ring, the cam surface 58*c* tapering outwardly from sidewall 58*a* and forwardly from the lock ring, the land 58*e* extending perpendicularly from sidewall 58*b* and intersecting the abutment shoulder 58*d*, and the abutment shoulder tapering outwardly from land 58*e* and intersecting cam surface 58*c* to form the V-shaped peak.

FIG. 3 shows a cross-section of the plug 20 mated to the receptacle 10 with their respective end faces 26, 16 abutting metal-to-metal contact. Bayonet pin 18 is captivated in a detent formed at the terminus 53.

FIG. 4 shows the inner wall internal view of the coupling sleeve 32 being unfolded and detailing the helical grooves 50 and their terminus 53, the cam 58 extending from the lock ring and located in the terminus, and the bayonet pin 18 being shown in phantom when working against the wall of its helical groove and in solid when engaging the cam surface 58*c* just prior to being captivated by the detent. The wave washer 52 biases lock ring 56 axially forward. A detent for captivating the pin is formed at the terminus 53 by the abutment shoulder 58*d*, the land 58*e*, a wall of the groove, and an axial endwall 55 at the end of the groove.

The angle shown by "B" represents the angle of inclination of abutment shoulder 58*d* relative to the perpendicular from the lock ring. The more steeply inclined that "B" is (i.e., as "B" approaches 0°), the greater is the resistance to uncoupling rotation (i.e., the greater is the external torque needed to cam the lock ring rearwardly). The more shallow that "B" is (e.g., as "B" approaches 90°), the lesser is the resistance to uncoupling rotation. The angle shown by "A" represents the angle of cam surface 58*c*. So as to not resist coupling approach of the pin (shown in phantom and indicated by the letter "C"), the angle "A" would be shallow.

Once the pin 18 has advanced beyond the V-shaped peak formed by cam surface 58*c* and abutment shoulder 58*d*, the pin abuts endwall 55, the lock ring 56 snaps forwardly and land 58*e* drives the pin against the groove, and uncoupling rotation is prevented by the action of abutment shoulder 58*d*. Sufficient external torque, however, will drive the cams 58 rearwardly. When the lock ring "snaps" forward an audible click is heard indicative of full metal-to-metal mating.

FIG. 5 shows the bayonet pins 18 captivated within respective of the detents defined by each of the cams 58, each bayonet pin being prevented from uncoupling rotation in the direction of arrow "D" by the abutment shoulder. The locking key 60, in combination with the washer 52, constantly biases each cam 58 into its respective terminus 53.

FIGS. 6, 7 and 8 show assembly of the coupling member 30 relative to the plug shell. FIG. 6 shows retaining nut 36 including internal thread 40 and annular flange 38, the retaining ring 46, and the pair of waved washers 44 being stacked and interposed between the retaining ring and annular flange. In operation, the stacked washers tend to dampen vibration forces which may act on the coupling member and thereby cause uncoupling rotation.

FIG. 7 shows the plug shell 20 with stepped annular flange 28, the annular groove 25 and the waved washer 52 disposed in the groove.

FIG. 8 shows coupling sleeve 32, the collar 34 having external thread 41 and axial keyway 62, and lock ring 56 having its key 60 disposed in the keyway. For assembly of coupling member 30, the retainer nut 36 is positioned about plug 12 and abutted against flange 28. Collar 34 is threaded with the retainer nut and non-removably staked therewith.

FIG. 9 shows a fragment of collar 34 including keyway 62 and key 60 of lock ring 56 being disposed in the keyway.

FIGS. 10A and 10B show alternate construction of vibration damping wherein plug shell 12 includes a radial flange 68, and coupling member 30 comprises a retaining nut 70 having an annular flange 72, an annular recess 74, an L-shaped retainer ring 76 fitted in the recess, and a flat one-piece generally annular washer 78 comprised of resilient material disposed between the annular flange 72 and retainer ring 76.

The radial flange 68 has a rearward facing axial endwall 69 which is disposed in a plane peripendicular to the connector axis and the annular flange 72 has a forward facing axial endwall 80 which is frusto-conical. The retainer ring has a rearward facing end face 79 which is adapted to lie in the same plane as endwall 69. When mounted to the plug, the flat washer 78 has its flat faces facing in opposite axial direction with one face abutting end face 79 and endwall 69 and the other face confronting the frusto-conical endwall 80, the washer 78 having its outer radial portion abutting the frusto-conical endwall 80 and end face 79 and its inner radial portion abutting the endwall 69 of radial flange 68 and spaced from the frusto-conical endwall 80. During operation for preventing vibration, flange 68 and frusto-conical endwall 80 would move axially relative to one another and place a torque on the washer 78 causing the washer 78 to resiliently deform into a frusto-conical shape which shape would tend to drive the coupling member rearwardly from the annular flange and restore the washer 78 into its flat undeformed cross section.

I claim:

1. An electrical connector assembly comprising first and second connector members, a coupling member rotatably mounted to said first connector member for connecting to the second connector member to cause a portion of said first connector member to abut a portion of said second connector member, one and the other said second connector member and said coupling member including, respectively, a radially extending bayonet pin and a wall provided with a helical groove arranged to be threadably engaged by the pin for pulling the connector members together into mated relation upon rotation of the coupling member in one direction, said helical groove having an entrance port for receiving the pin and spiralling axially rearward from the port to its terminus, and locking means for locking the mated assembly together by restraining said coupling member against unwanted rotation in the other direction, said locking means being characterized by a cylindrical lock ring disposed in a plane perpendicular to the axis of rotation and in a clearance fit about said first connector member for axially sliding movement thereto, said lock ring having a top and a bottom surface and a shoulder, said shoulder being normally free from engagement with said bayonet pin and extending longitudinally forward from the top surface and into the terminus for captivating said bayonet pin when the pin is advanced thereto; locator means for constantly locating the shoulder adjacent to the terminus; and bias means acting against the bottom surface for biasing the lock ring axially towards said helical groove.

2. The assembly as recited in claim 1, further including damping means acting on said coupling member and said first connector member for damping external vibration forces which may act on and tend to cause rotation of the coupling member in said other direction.

3. The assembly as recited in claim 1 wherein said lock ring comprises a closed annulus having a forward and rearward face, an outer circumferential face, and a key extending radially outward from the circumferential face, and said locator means comprises an axial keyway on the inner wall of said coupling member for receiving said key.

4. The assembly as recited in claim 3 wherein said lock ring includes an inner circumferential face sized to clearance fit about the outer periphery of said first connector member and is constrained for rotation with the coupling member thereabout.

5. The assembly as recited in claim 3 wherein said coupling member comprises a rearward sleeve portion including a flange extending radially inward therefrom for mounting the coupling member adjacent to an annular flange extending radially outward from the first connector member and a forward sleeve portion including said axial keyway and said helical groove.

6. The assembly as recited in claim 3 wherein a cam including a cam surface and said shoulder extends perpendicularly from the forward face of said lock ring and intersect to form a V-shaped peak, said bayonet pin driving the lock ring axially rearward when the pin is advanced against the cam.

7. The assembly as recited in claim 2 wherein an annular flange extends radially outward from said first connector member, a radial flange extends radially inward from said coupling member, said damping means are disposed between and act on the flanges for biasing the flanges in opposite axial directions, and further including means for captivating the annular flange adjacent to the radial flange.

8. The assembly as recited in claim 1 wherein said second connector member and said coupling member include, respectively, three said bayonet pins and three said helical grooves with each said helical groove having its entrance port circumferentially spaced at the forward end of said coupling member, said bayonet pins being circumferentially spaced so as to be aligned with said entrance ports for mating of the connector members, and said lock ring includes three shoulders, each said shoulder being located in the terminus of one respective helical groove whereby to captivate one respective bayonet pin.

9. An electrical connector comprising a pair of connector members separably held together by a coupling member rotatably mounted on one connector member and engaging the other connector member, a bayonet coupling arrangement comprising a bayonet pin extending radially outward from said other connector member and the coupling member including a helical groove spiralling axially rearward to its terminus and receiving the bayonet pin, and lock means for locking the bayonet pin in the terminus of the helical groove, the lock means characterized by a body including a rear face and a forward face having a pair of forward flanks which intersect longitudinally forward therefrom to define a V-shaped cam, said body being connected by a radial key to said coupling member and constrained to slide longitudinally between a first and a second position in response to the bayonet pin being driven laterally across the cam upon rotation of the coupling member, said helical groove including an endwall having a longitudinally extending face the plane of which extends generally through the axis of rotation, and bias means disposed behind the rearward face for biasing said body towards said first position so that said bayonet pin abuts both the endwall and one said flank of the cam.

10. The connector as recited in claim 9 wherein said lock means comprises said body forming a closed annular lock ring, said lock ring being generally planar and including said forward face and said rear face with each of the faces facing in opposite axial directions, the forward face including the forward flanks which extend perpendicularly forward therefrom and intersect to form said V-shaped cam.

11. An electrical connector assembly comprising first and second connector members, a coupling member rotatably mounted to said first connector member for coupling the connector members together upon rotation of the coupling member in one direction, said first connector member and said coupling member including, respectively, an annular flange having a forwardly facing endwall and a radial flange having a rearwardly facing endwall, characterized by damping means for damping external vibration forces which may act on and tend to cause unwanted rotation of the coupling member in the other direction, said damping means comprising a generally flat annular washer being disposed between said flanges and clearance fit about the first connector member, said forwardly facing end wall including a frusto-conical surface tapering radially inward and axially rearward, and said rearwardly facing end wall being disposed in a plane substantially perpendicular to the axis of rotation, and said washer having an outer annular portion of one of its flat faces abutting the frusto-conical surface and an inner annular portion of its other flat face abutting the planar surface of the rearwardly facing end wall, coupling rotation of the coupling member causing the end walls to be driven axially together and against the washer and the washer to elastically deform into a frusto-conical shape.

* * * * *